US008312602B2

(12) United States Patent
Paik

(10) Patent No.: US 8,312,602 B2
(45) Date of Patent: Nov. 20, 2012

(54) BUCKLE EQUIPPED WITH A WHISTLE

(76) Inventor: Jisook Paik, Seoul (KR)

( * ) Notice: Subject to any disclaimer, the term of this patent is extended or adjusted under 35 U.S.C. 154(b) by 657 days.

(21) Appl. No.: 12/291,282

(22) Filed: Nov. 7, 2008

(65) Prior Publication Data

US 2010/0115736 A1 May 13, 2010

(51) Int. Cl.
*A44B 1/04* (2006.01)
*A44B 11/25* (2006.01)

(52) U.S. Cl. ..... 24/163 R; 24/308; 24/614

(58) Field of Classification Search ..... 24/163 K, 24/163 R, 3.6, 3.11, 3.12, 198, 204, 216; 63/1.13; 446/204, 216; 116/DIG. 1
See application file for complete search history.

(56) References Cited

U.S. PATENT DOCUMENTS

| | | | | |
|---|---|---|---|---|
| 1,548,628 | A * | 8/1925 | Petrie | 446/26 |
| 5,604,958 | A * | 2/1997 | Anscher | 24/3.1 |
| 6,668,428 | B2 * | 12/2003 | Moeller | 24/163 R |
| 7,043,802 | B2 * | 5/2006 | Moeller et al. | 24/429 |
| 7,581,509 | B2 * | 9/2009 | Eventoff | 116/137 R |

FOREIGN PATENT DOCUMENTS

| | | |
|---|---|---|
| KR | 1988-0000926 | 3/1988 |
| KR | 0215634 | 12/2000 |
| KR | 0286868 | 1/2001 |
| KR | 10-0511434 | 8/2005 |
| KR | 10-0756277 | 8/2007 |

* cited by examiner

*Primary Examiner* — Robert J Sandy
*Assistant Examiner* — Matthew Sullivan
(74) *Attorney, Agent, or Firm* — Jordan and Hamburg LLP

(57) ABSTRACT

A buckle provided with a detachable whistle. The buckle includes: a buckle body coupled to an end of a belt; and a whistle that is detachably mounted on a sliding part provided at one side of the buckle body.

15 Claims, 13 Drawing Sheets

BUCKLE EQUIPPED WITH A WHISTLE

BACKGROUND OF THE INVENTION

1. Field of the Invention

The present invention relates to a buckle that can connect or fix a belt by being coupled to the belt, and more particularly, to a buckle equipped with a whistle.

2. Description of the Related Art

Generally, a buckle has been widely used in a fastening belt of a climbing knapsack or a school satchel. Particularly, goods using the buckle are used mainly in cases where a user takes activities out-of-door.

In other words, the goods using the buckle are widely used household goods. Particularly, when the user enjoys hiking, boating, camping or climbing in the fields, the user uses goods provided with plural buckles to fasten in various types.

On the other hand, during the outdoor activities, various emergency situations to require urgent rescue may occur. For example, the user's voice may be not transmitted far enough, or the user's voice cannot be heard because of ambient noise. Accordingly, it is desirable that the user participating in the above outdoor activities carry a whistle for safety.

Such emergency may occur to everybody. However, most users do not expect that the emergency happens to himself/herself. Accordingly, the user taking the above outdoor activities does not take care to carry the whistle. Therefore, there have been cases where the user couldn't ask for help because he/she did not carry the whistle when the emergency occurs to the user and thus has an accident.

FIG. 1 is an exemplary view illustrating a conventional buckle equipped with a whistle.

As described above, the buckle is used to couple various goods to each other, or to fasten the goods to a body of the user. For example, the buckle is used in a shoulder belt, a chest belt, a waist belt, a connection belt and a pocket belt of a knapsack.

On the other hand, in U.S. Pat. No. 6,668,428, there is disclosed a buckle wherein a whistle 12 is integrally provided to a buckle body, particularly, to a female receptacle 11 as shown in FIG. 1. Accordingly, the user who does a lot of the outdoor activities can always carry the whistle in case of emergency.

However, when the user wants to use the whistle by using the conventional buckle equipped with the whistle as shown in FIG. 1, the user has to use the female receptacle 11 connected to the belt after he/she separates the female receptacle 11 and a male latch 17 from each other firstly, which has been very inconvenient to the user. In other words, the conventional buckle equipped with the whistle as shown in FIG. 1 has a problem that the buckle 11 and 17 should be unlocked so as to allow the user to use the whistle because the female receptacle 11 and whistle 12 of the buckle are integrated with each other.

In addition, the whistle is always exposed to the outside because the whistle is integrated with the conventional buckle. Thus, appearance of the buckle is degraded.

In addition, as described above, there has been a sanitary problem because the whistle is always exposed to the outside. In other words, the whistle is contacted to a mouth of the user when it is used. Accordingly, the whistle is exposed to various exhaust gas and dusts while the user takes the outdoor activities, which is harmful to the user for sanitary reasons.

SUMMARY OF THE INVENTION

Accordingly, an object of the present invention is to provide a whistle that is attachable to a buckle so as to prevent pollution.

Additional advantages, objects, and features of the invention will be set forth in part in the description which follows and in part will become apparent to those having ordinary skill in the art upon examination of the following or may be learned from practice of the invention.

According to an aspect of the present invention, there is provided a buckle, which includes: a buckle body coupled to an end of a belt; and a whistle that is detachably mounted on a sliding part provided at one side of the buckle body.

The whistle may include a whistle body to generate sound; and a connection part provided at the whistle body so as to be connected to the sliding part provided at the one side of the buckle body.

The connection part may include an insertion groove into which the sliding part can be inserted and fixed.

The connection part may include a fixing groove into which a projection formed on the sliding part can be inserted and fixed.

The connection part may include: a front surface provided with an insertion groove having the same shape as an one end of the sliding part, where the one end of the sliding part can be inserted into the insertion groove; a right side surface, formed to the right of the front surface, provided with the insertion groove formed in a length direction of the connection part, where the sliding part can be inserted into the insertion groove; a flat surface extended in the length direction of the connection part from an upper part of the front surface; a rear surface formed in a direction opposite to the front surface in order to support the sliding part; and a bottom surface forming a bottom of the connection part.

The insertion groove may be extended toward the rear surface from one side of the right side surface connected to the front surface.

The insertion groove may be extended to a position of the right side surface that is spaced by a predetermined gap from the rear surface.

The insertion groove may be extended to the rear surface from one side of the right side surface connected to the front surface.

The insertion groove may be formed to pass through the front surface, right side surface and rear surface.

At least one of the flat surface and bottom surface may be provided with a fixing groove into which the projection formed on the sliding part can be inserted and fixed.

The fixing groove may be formed at a position near the front surface.

The fixing groove may be formed at a position near the rear surface.

The buckle body may include a male latch connected to a first belt and a female receptacle connected to a second belt in order to receive and fix the male latch.

The sliding part may be formed at the male latch or female receptacle.

The male latch may be separated from the female receptacle by pressing the outwardly projected male latch in a state that the buckle body is received in the female receptacle.

The male latch of the buckle body may be separated from the female receptacle by a pressing unit formed at the outside of the female receptacle.

The buckle body may be formed of single body in order to adjust a length of the belt or control tension of the belt.

BRIEF DESCRIPTION OF THE DRAWINGS

The above objects, other features and advantages of the present invention will become more apparent by describing the preferred embodiments thereof with reference to the accompanying drawings, in which.

DETAILED DESCRIPTION OF THE INVENTION

Figure 1:
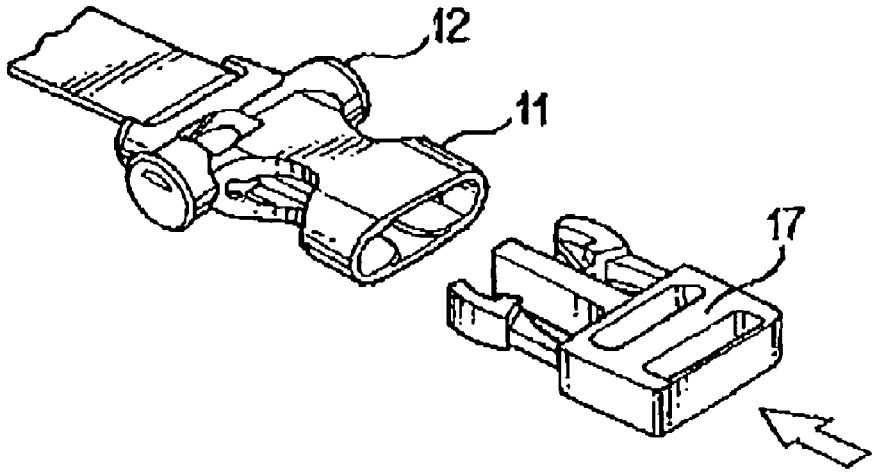
Fig. 1 Related Art
FIG. 1 is an exemplary view illustrating a buckle equipped with a conventional whistle.

Hereinafter, preferred embodiments of the present invention will be described in detail with reference to the accompanying drawing. The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined within the scope of the appended claims. In the entire description of the present invention, the same drawing reference numerals are used for the same elements across various figures.

Figure 2:
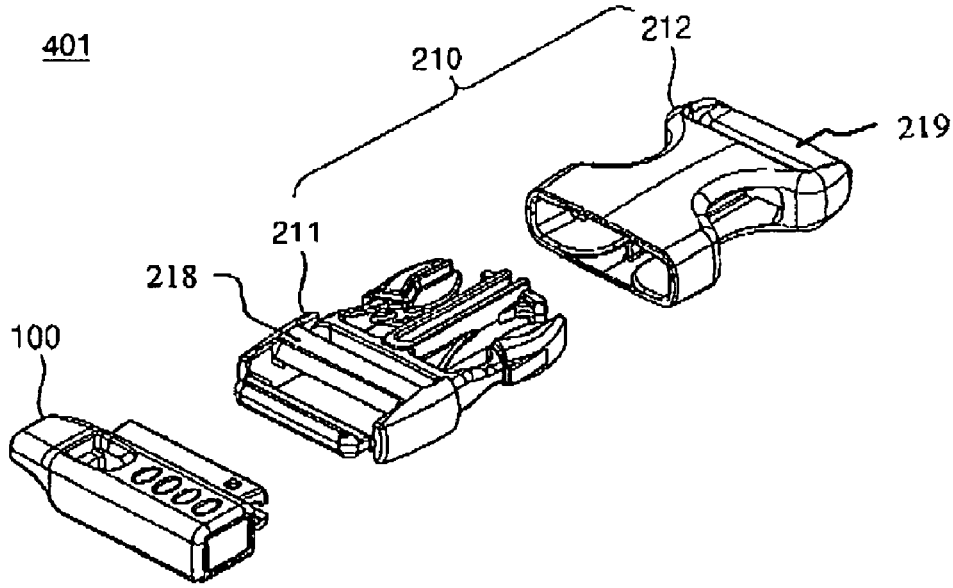
FIG. 2 is an exploded perspective view illustrating a buckle equipped with a whistle according to one exemplary embodiment of the present invention.

FIG. 2 is an exploded perspective view illustrating a buckle equipped with a whistle according to one exemplary embodiment of the present invention.

As described in FIG. 2, the buckle equipped with the whistle includes a buckle body 210 coupled by portions 218, 219 to ends of a belt (also see FIG. 21) to keep tension of the belt constant and a whistle 100 detachably mounted on a sliding part formed at one side of the buckle body.

The buckle body 210 is mounted on an end of a belt attached to goods such as a knapsack, a school satchel or a helmet in order to connect or separate two belts from each other. As shown in the drawing, the buckle body includes a male latch 211 and a female receptacle 212. It is desirable that the male latch 211 and female receptacle 212 are made of plastic for elasticity. Generally, the belt is attached to the knapsack or school satchel as described above. For example, in the knapsack, the belt is variously used as a shoulder belt, a chest belt or a waist belt. Hereinafter, the belt will be used to mean the various kinds of belt as described above. On the other hand, a sliding part is provided at one side of the buckle body. The whistle can be mounted by sliding on the sliding part. The sliding part may be formed at one side of the male latch 211, or at the female receptacle 212. In the embodiment of FIG. 2, the sliding part is formed at one side of the male latch 211.

The whistle 100 generates sound by air passing through a flue when a user breathes out. The whistle 100 is used to alarm emergency to other person when emergent situation occurs during outdoor activities as described above. On the other hand, the whistle used in the present invention can be used in a state that it is mounted on the buckle body 210. The whistle includes a whistle body to generate sound and a connection part provided at the whistle body, where the connection part is coupled to the sliding part formed at the buckle body.

In other words, in the buckle according to the embodiment, the connection part of the whistle 100 is attachable to the sliding part formed at the buckle body 210. Particularly, in the embodiment, the buckle body 210 is comprised of the male latch 211 and female receptacle 212 wherein the sliding part is formed at one side of the male latch. The buckle equipped with the whistle according to the one embodiment will be explained in more detail below with reference to FIGS. 3 to 6.

Figure 3:
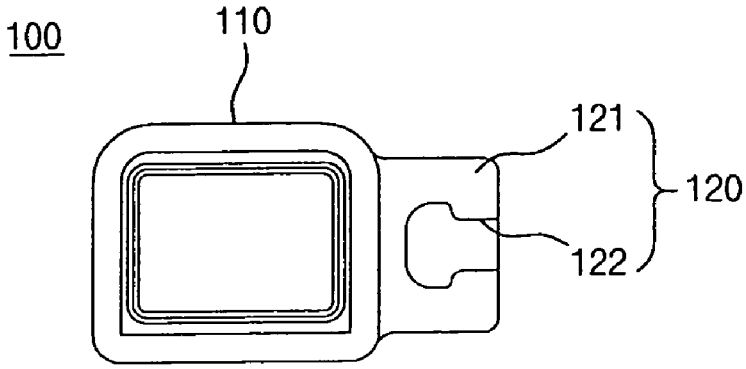
FIG. 3 is a front view of the whistle shown in FIG. 2.
Figure 4:
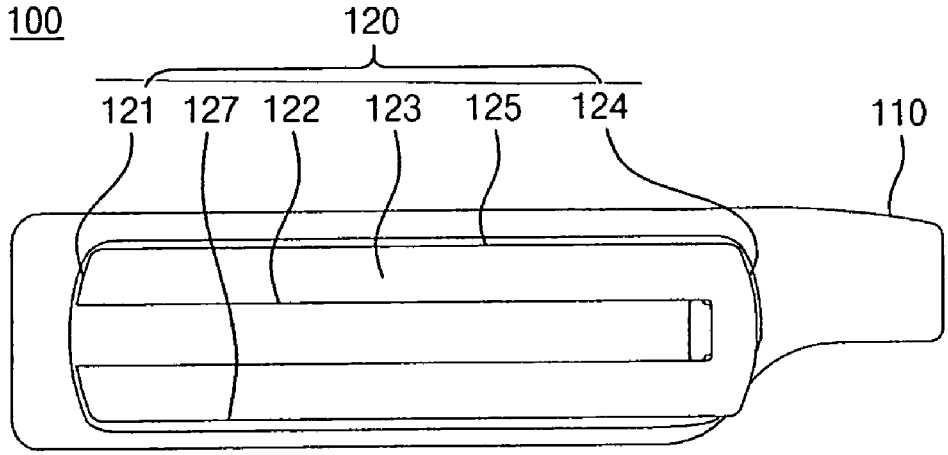
FIG. 4 is a right side view of the whistle shown in FIG. 2.
Figure 5:
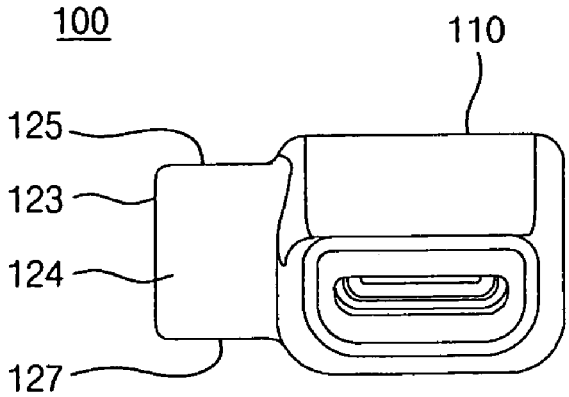
FIG. 5 is a rear view of the whistle shown in FIG. 2.
Figure 6:
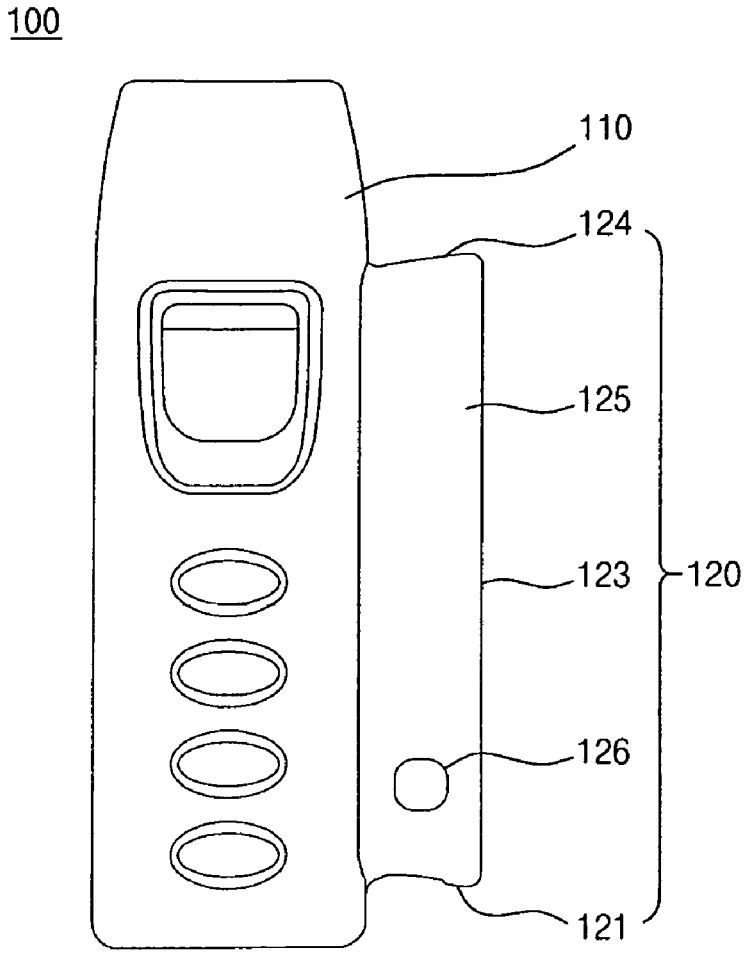
FIG. 6 is a plan view of the whistle shown in FIG. 2.

FIG. 3 is a front view of the whistle shown in FIG. 2 and FIG. 4 is a right side view of the whistle and FIG. 5 is a rear view of the whistle and FIG. 6 is a plan view of the whistle. FIGS. 3 to 6 show structure of the whistle 100 shown in FIG. 2.

Referring to the front view of FIG. 3, the whistle 100 includes a whistle body 110 to generate sound and a connection part 120 connected to the sliding part formed at the buckle body.

The whistle body 110 may be formed in various shapes so as to generate sound. In addition, the whistle body 110 can be moved with being connected to the buckle body through the connection part and thus may be formed in various sizes according to the buckle body.

The connection part 120 is formed at one side of the whistle body and connected to the sliding part of the buckle body. The connection part of hexahedron shape is shown in FIGS. 3 to 6. However, the connection part may be also formed in various shapes. In other words, the connection part may include a front surface 121 provided with an insertion groove 122 having the same shape as an one end of the sliding part, a right side surface 123 that is formed to the right of the front surface and provided with the insertion groove 122 formed in a length direction of the connection part, a flat surface 125 extended in the length direction of the connection part from an upper part of the front surface, a rear surface 124 formed in a direction opposite to the front surface in order to support the sliding part, and a bottom surface 127 forming a bottom of the connection part, where the sliding part can be inserted into the insertion groove. In other words, the connection part is provided with the insertion groove into which the sliding part can be inserted. Accordingly, the sliding part is inserted into the insertion groove, thereby connecting the connection part and sliding part to each other.

The front surface 121 is a surface projected vertically from one side of the whistle body 110 as shown in FIG. 3. The front surface is provided with the insertion groove 122 having the same shape as one end of the sliding part. In other words, the one end of the sliding part should be inserted into the insertion groove 122 formed at the front surface and right side surface in order to connect the sliding part formed at the buckle body to the connection part.

Accordingly, the insertion groove is formed at the front surface in the same shape as one end of the sliding part. The shape of the insertion groove 122 formed at the front surface may not be same as the shape of the one end of the sliding part. However, it is desirable that the shape of the same as the shape of the one end of the sliding part so as to connect the sliding part to the connection part tightly.

In addition, for the same reason, it is desirable that the insertion groove has a size enough for insertion and movement of the sliding part.

The right side surface 123 provides a space by which the sliding part inserted into the connection part through the front surface. For that purpose, the insertion groove 122 is formed in the length direction of the connection part or sliding part. In other words, the insertion groove is extended toward the rear surface 124 from one side of the right side surface connected to the front surface 121. However, the insertion groove 122 is extended to the position of the right side surface 123 spaced by a predetermined gap from the rear surface 124, thereby preventing the sliding part from passing through the rear surface.

In other words, the sliding part is moved along the right side surface with being inserted into the connection part through the insertion groove of the front surface and right side surface and stopped by being supported by the insertion groove that is formed up to the rear surface. However, when an additional unit to fix the sliding part at a predetermined position, for example, a fixing groove is provided, the insertion groove 122 may be formed also at the rear surface 124 similarly to the front surface 121. In this case, the insertion groove may be formed at the right side surface 123 so as to be extended from the front surface to the rear surface. On the other hand, when the insertion groove is formed also at the rear surface, the sliding part may be inserted into the front surface or rear surface.

The flat surface 125 supports the right side surface 123 with the front surface 121, rear surface 124 and bottom surface 127. Particularly, as shown in FIG. 6, the flat surface is provided with a fixing groove 126 to fix the sliding part to the connection part at a predetermined position. In other words, the fixing groove 126 is a groove formed at the flat surface so as to receive the projection formed at the sliding part. The sliding part can be fixed to a predetermined position of the connection part through the fixing groove 126. As shown in FIG. 6, the fixing groove 126 may be formed at a position near the front surface 121 or rear surface 124.

In addition, the fixing groove 126 may not necessarily be formed by one. Accordingly, the fixing groove 126 of more than two may be formed at the positions near the front surface and rear surface. In this case, a plurality of projections corresponding to the positions and number may be formed at the sliding part. However, it is desirable that the fixing groove and projections are formed by the proper number, for example, one or two in order to separate the connection part and sliding part from each other, in addition to fixing them to each other.

The rear surface 124 is a surface facing the front surface. Generally, the rear surface may be formed of a plate that is not provided with the insertion groove as shown in FIG. 5. However, as described above, the insertion groove may be formed at the rear surface. In this case, the user can insert the sliding part into the any one of the front surface and rear surface.

The bottom surface 127 is a surface facing the flat surface and supports the front surface, rear surface and right side surface. On the other hand, the fixing groove 126 may not necessarily be formed at the flat surface. Accordingly, the projection of the sliding part may be formed at the position corresponding to the position of the fixing groove of the bottom surface. In addition, the fixing groove may be formed at both of the flat surface and bottom surface. However, in this case, it is desirable that the fixing groove of the proper number is formed at the flat surface and bottom surface in order to separate the connection part from the sliding part smoothly.

On the other hand, the sliding part formed at the buckle body 210 is inserted into the connection part 120. The insertion groove having the shape similar to the sliding part is formed at the connection part in the length direction of the connection part or sliding part. However, the shape of the connection part is not limited the hexahedron shape. In other words, the connection part may be formed in various shapes such as a round shape that can include the insertion groove 122.

Figure 7:
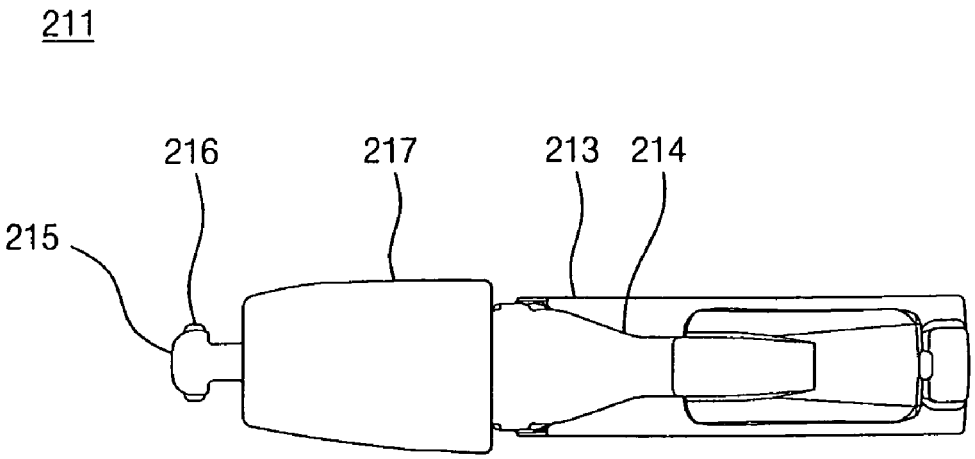
FIG. 7 is a front view of a male latch of a buckle body shown in FIG. 2.
Figure 8:
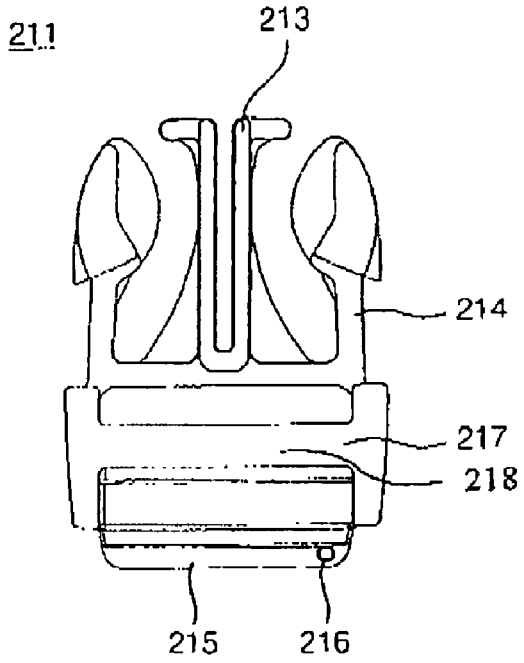
FIG. 8 is a plan view of the male latch of the buckle body shown in FIG. 2.

FIG. 7 is a front view of the male latch of the buckle body shown in FIG. 2 and FIG. 8 is a plan view of the male latch of the buckle body shown in FIG. 2.

In the one embodiment, the buckle body 210 includes the male latch 211 and female receptacle 212. The male latch 211 includes a first end 217 coupled to the end of the belt, a guide projection 213 projected from the middle of one side of the first end, a pair of hooks 214 projected from the one side of the first end about the guide projection, and the sliding part 215 that is projected from the other side of the first end and inserted into the connection part 120.

The first end 217 is a portion of the male latch that is coupled to the end of the belt.

The guide projection 213 is provided between the pair of hooks so as to fix a reference position by which the hooks are inserted into the female receptacle.

The hooks 214 are projected from both sides of the first end about the guide projection. The hook 214 is substantially coupled to the female receptacle by being inserted therein. The hook may include an arm extended from the first end and a projected part having three end surfaces projected from three sides of the end of the arm. The projected part may be formed in various types.

Referring to FIGS. 7 and 8, the projected part includes a first projected part having a first end surface projected from an outer surface, that is, a first surface of the arm, a second projected part having a second end surface projected from a left surface, that is, a second surface of the arm, and a third projected part having a third end surface projected from a right surface, that is, a third surface of the arm.

The sliding part 215 is formed at the other side of the first end and inserted into the connection part 120 of the whistle 100. In other words, the first end 217 basically has a structure to be connected to the end of the belt. The guide projection 213 and hook 214 are formed at one side of the first end. The sliding part 215 is formed at one side opposite to the side where the guide projection and hook are formed.

On the other hand, a projection 216 is formed on the surface of the sliding part 215, where the projection 216 is inserted into the fixing groove 126 of the connection part.

As described above, the position and number of the projection 216 may be variously set according to the position and number of the fixing groove 126.

The hooks are inserted and fixed in the female receptacle 212. The female receptacle 212 includes a second end to be coupled to the belt, an insertion part formed at a side opposite to the second end so as to receive the pair of hooks (and guide projection) of the male latch, and a receiving part to fix each of the projected parts that are formed at the pair of hooks inserted through the insertion part, where the receiving part allows the projected parts to be projected to the outside.

On the other hand, the sliding part 215 is formed at the male latch 211 in the above description, but not limited thereto. In other words, the sliding part may be formed at the female receptacle. In this case, it is desirable that the sliding part is formed at the side of the second end opposite to the side where the insertion part is formed.

Figure 21:
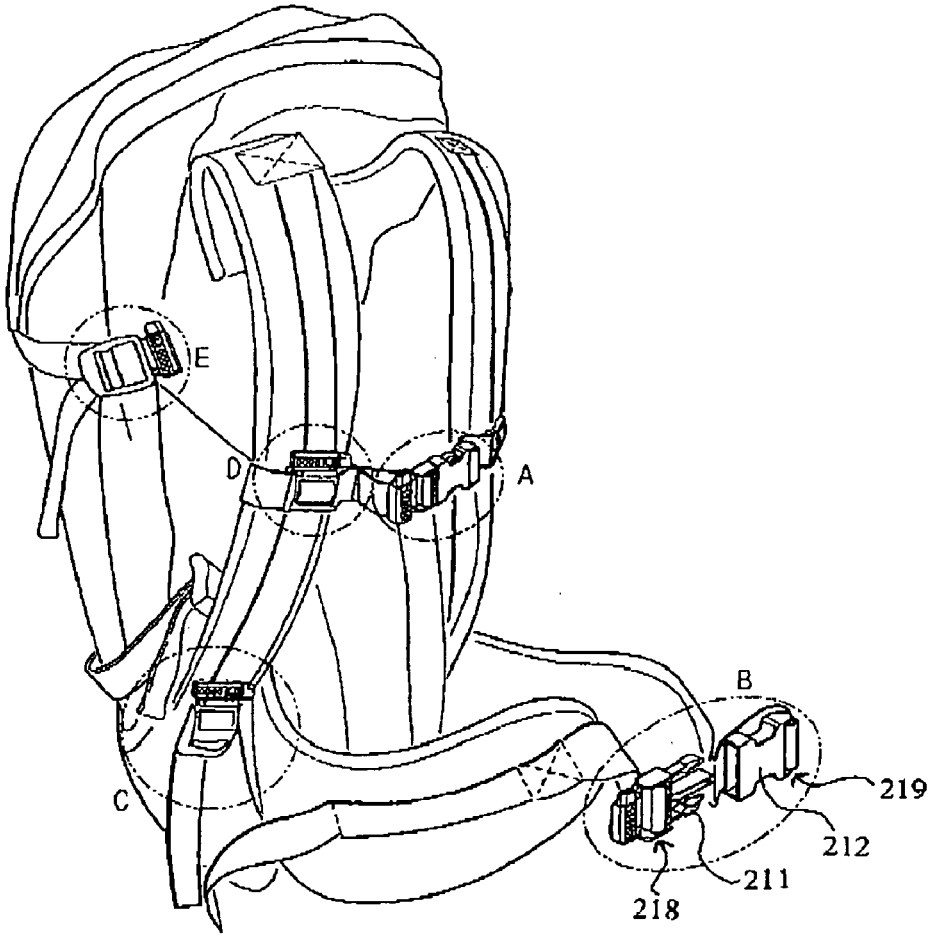
FIG. 21 is an exemplary view illustrating a state that the buckle equipped with the whistle is connected to a knapsack.

In other words, the buckle body 210 comprised of the male latch 211 and female receptacle 212 couples two ends of the belt to each other (as attached to the buckle body 210 at portions 218, 219 of the body 210—see FIG. 21) Any one of the male latch 211 and female receptacle 212 is provided with the sliding part 215 to be inserted into the connection part of the whistle.

Figure 9:
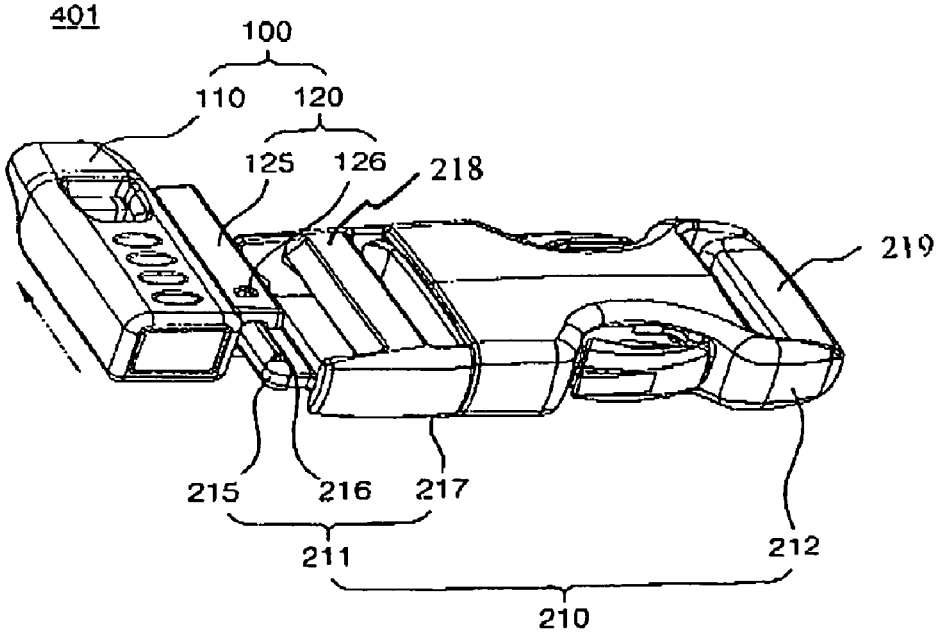
FIG. 9 is a combined perspective view illustrating the buckle equipped with the whistle according to one exemplary embodiment.
Figure 10:
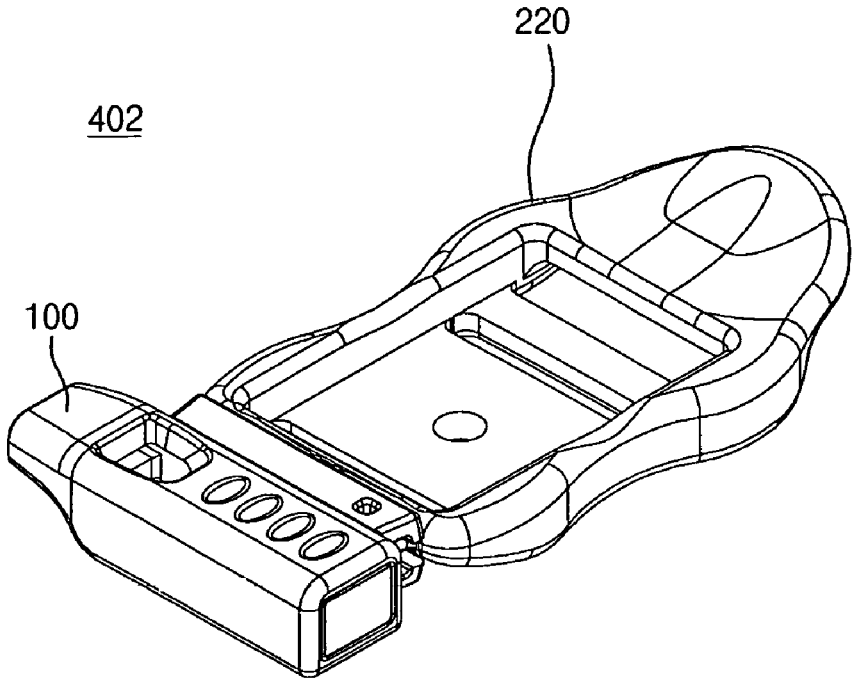
FIGS. 10 to 20 are perspective views illustrating buckles equipped with whistles according to other embodiments of the present invention.
Figure 11:
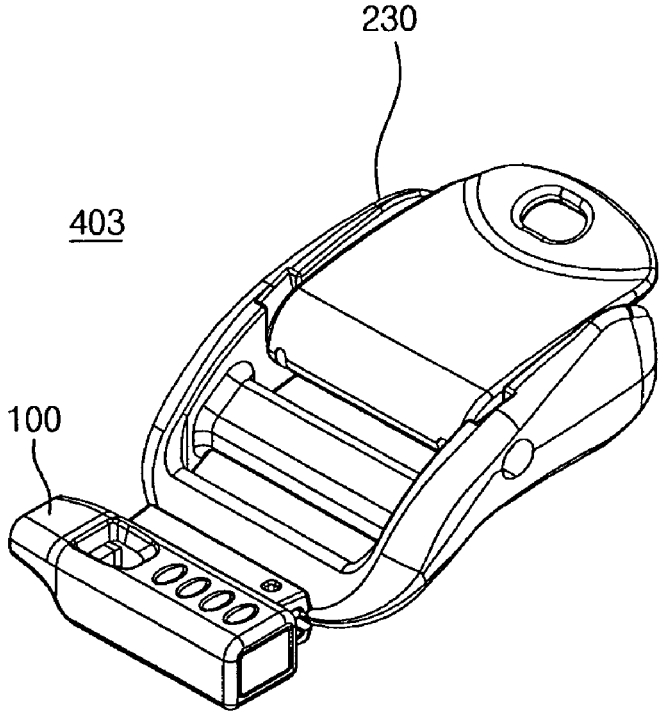
Figure 12:
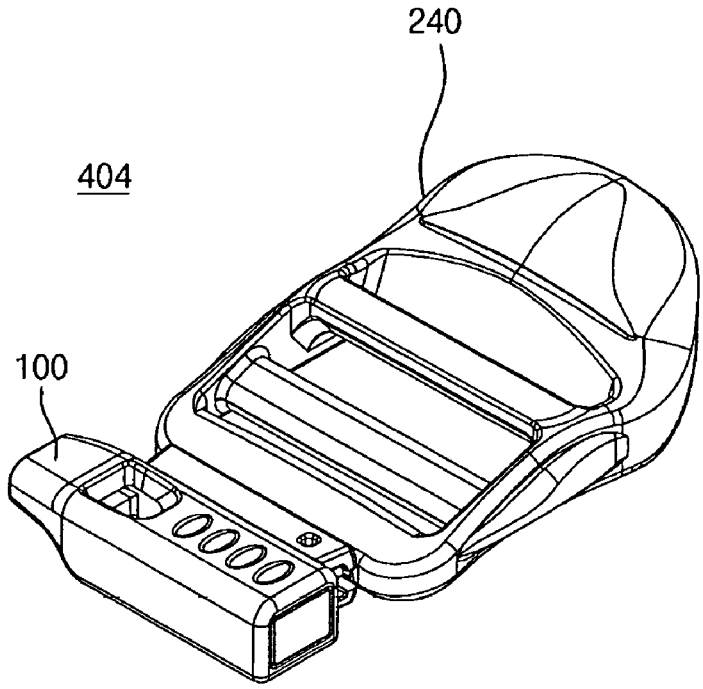

FIG. 9 is a perspective view illustrating a combined state of the buckle equipped with the whistle according to the one exemplary embodiment. FIG. 9 shows a state that the buckle equipped with the whistle is used.

In other words, in the buckle equipped with the whistle of the embodiment, the buckle body 210 is comprised of the male latch 211 and female receptacle 212. The sliding part 215 is formed at the male latch 211. The buckle body and whistle are coupled to each other by inserting the sliding part 215 of the buckle body into the connection part 120 of the whistle 100.

In this time, the whistle can be coupled to the buckle body at the fixed position by inserting and fixing the projection 216 of the sliding part 215 into the fixing groove 126 formed at the flat surface 125 of the connection part.

A method of using the buckle equipped with the whistle according to the one exemplary embodiment will be explained below.

When the user wants to enjoy climbing or camping, the user takes goods, for example, a knapsack provided with the buckle according to the embodiment. In this case, the user can start on climbing or camping with the whistle without additional preparation.

In this time, the user gets away from the crowded city. During movement, emergency to require the whistle does not usually occur and the whistle may be polluted by exhaust fumes and dusts. Accordingly, the user can separate the whistle from the buckle body and store it in the pocket or knapsack until it is necessary to use the whistle.

When the user arrives at the place such as mountain, sea and park for outdoor activities, the user can use the whistle anytime by connecting the whistle to the buckle body again.

When emergency occurs during the outdoor activities, the user can quickly use the whistle by separating the whistle attached to the buckle of the knapsack, etc. from the buckle body.

FIGS. 10 to 20 are perspective views illustrating buckles equipped with whistles according to other embodiments of the present invention.

The buckle includes a sliding part at a buckle body 220 to 320 connected to a belt and a whistle attachable to the buckle body through the sliding part. The buckle body may be formed in various shapes.

For example, the buckle body includes a male latch and a female receptacle similarly to the above embodiment. The belt can be locked or unlocked by coupling or separation of the male latch or female receptacle. The male latch and female receptacle may be formed in various types according to use thereof. On the other hand, in the case where the buckle body is comprised of the male latch and female receptacle, the sliding part may be formed at any one of the male latch or female receptacle.

On the other hand, the buckle body comprised of the male latch and female receptacle may be divided into open type and closed type according to construction thereof.

In other words, according to the open type buckle body, similarly to the above embodiment, both hooks 214 of the male latch are inserted into an insertion part of the female receptacle 212 and fixed in a receiving part that are opened at both sides of the insertion part. Then, the male latch and female receptacle are separated from each other by pushing the hooks fixed in the receiving part.

Figure 13:
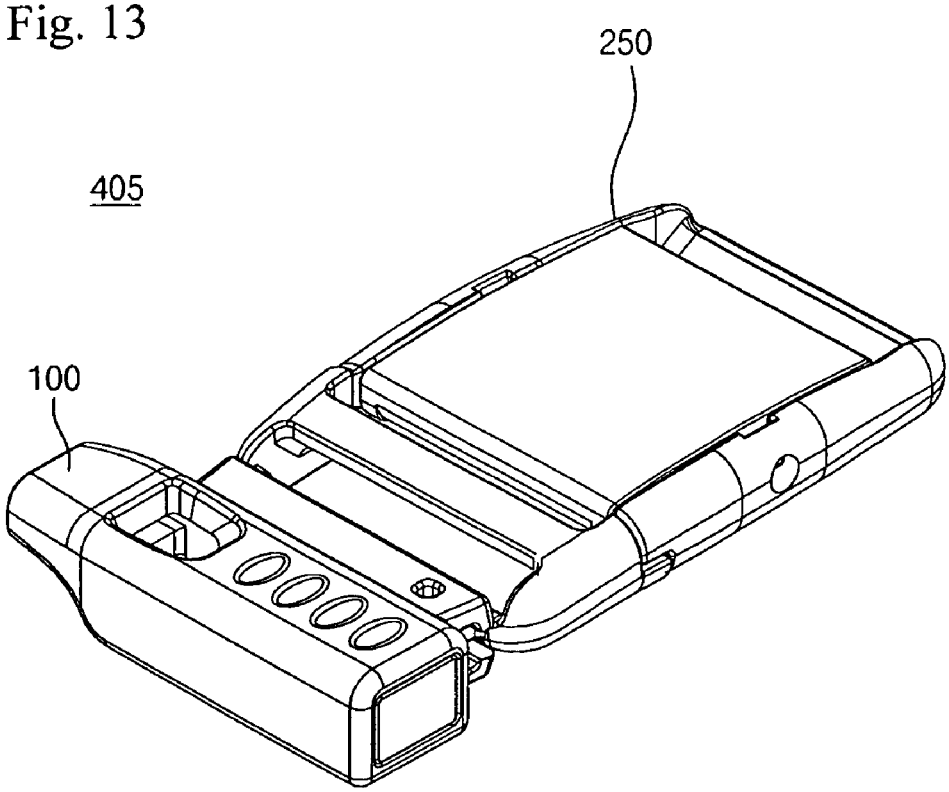
Figure 14:
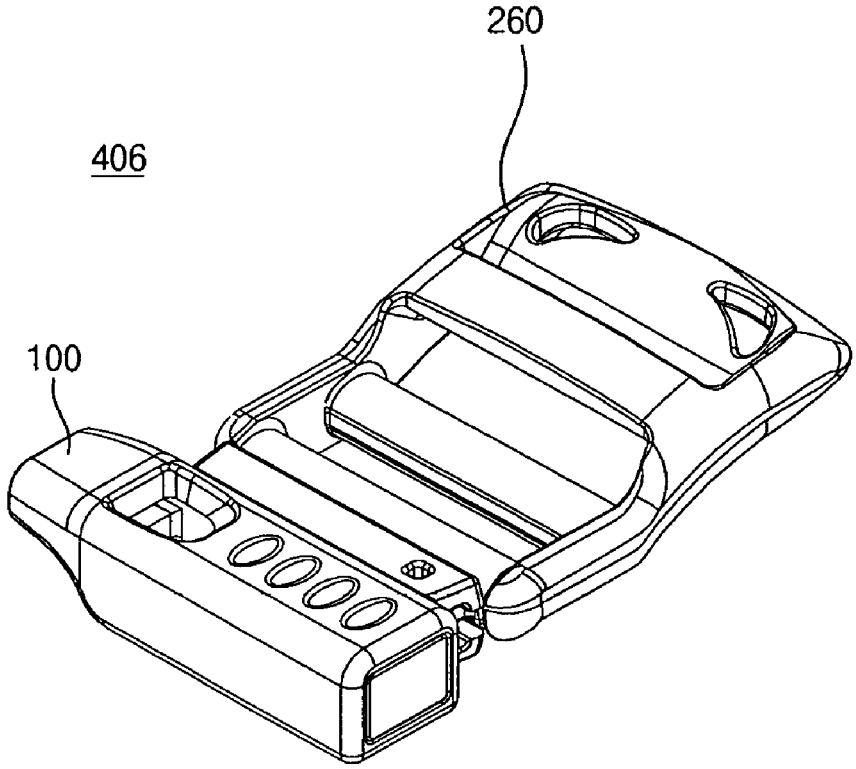
Figure 15:
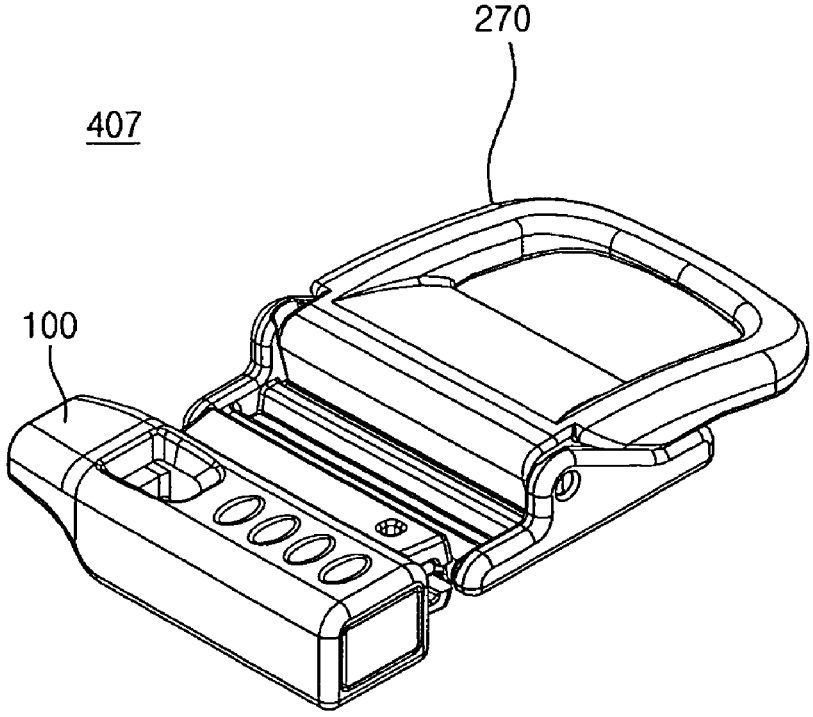
Figure 16:
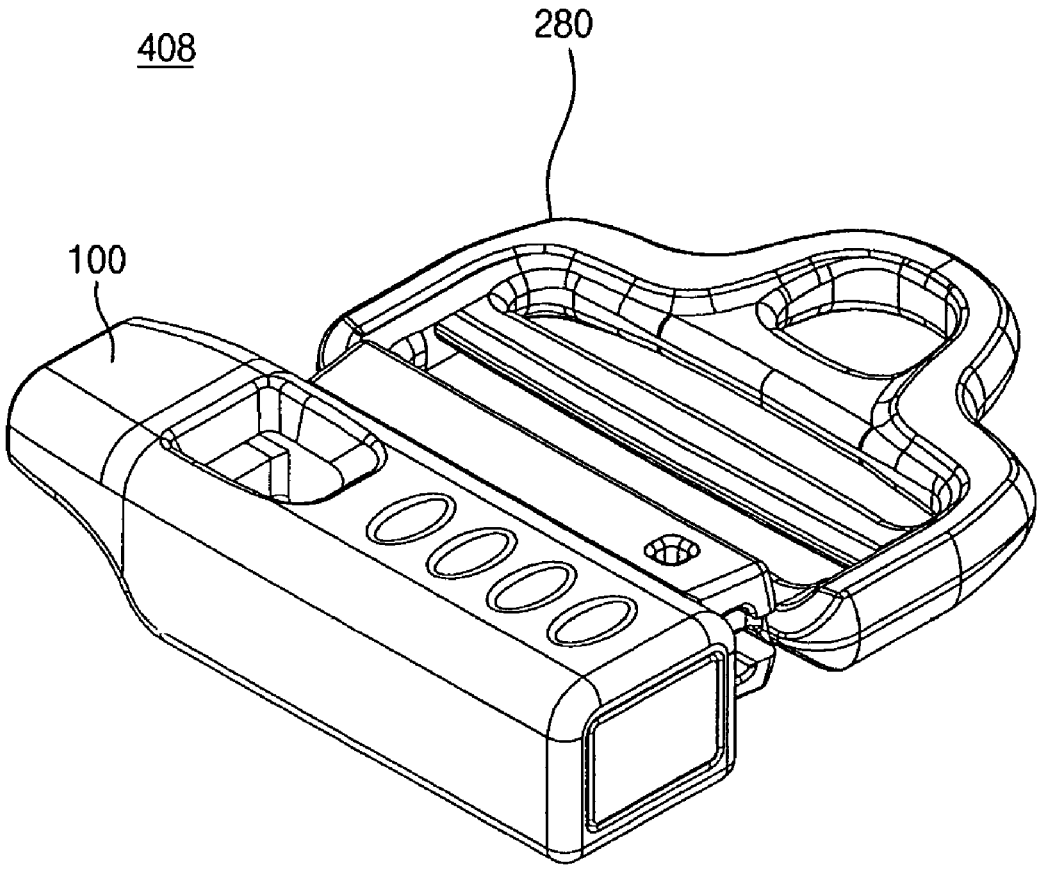
Figure 17:
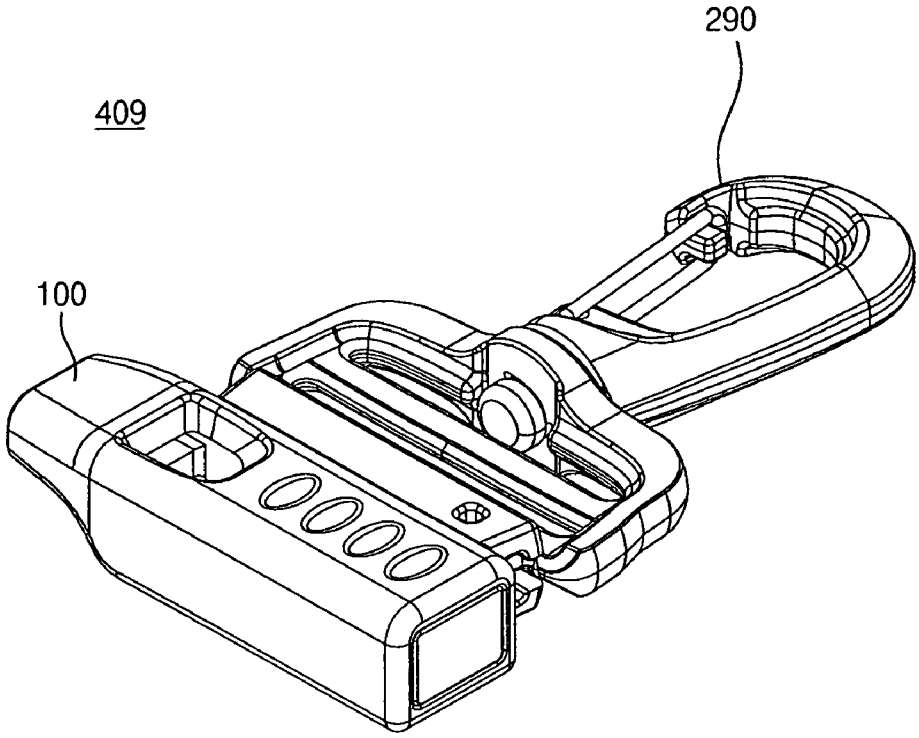
Figure 18:
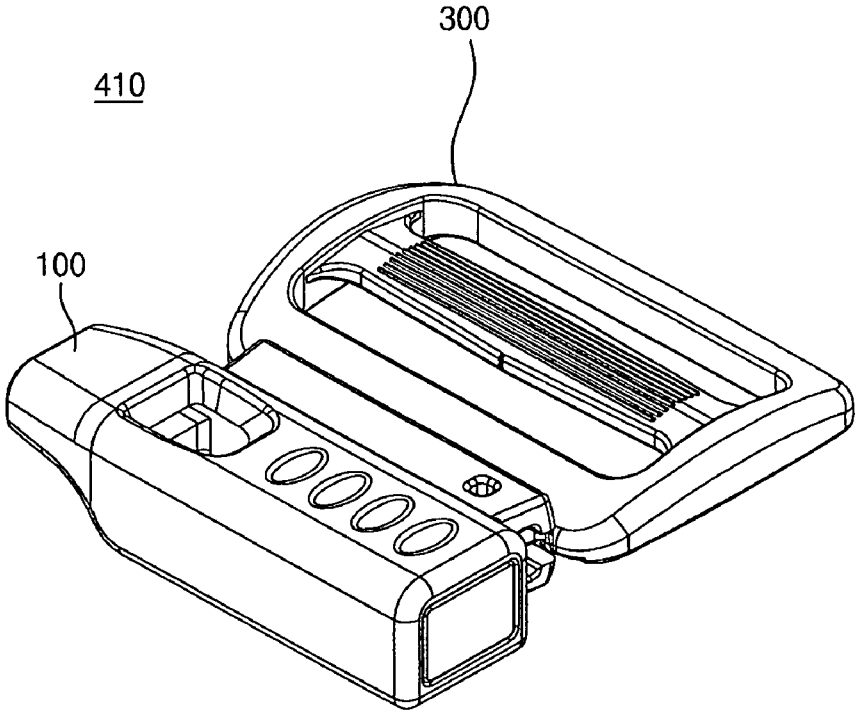
Figure 19:
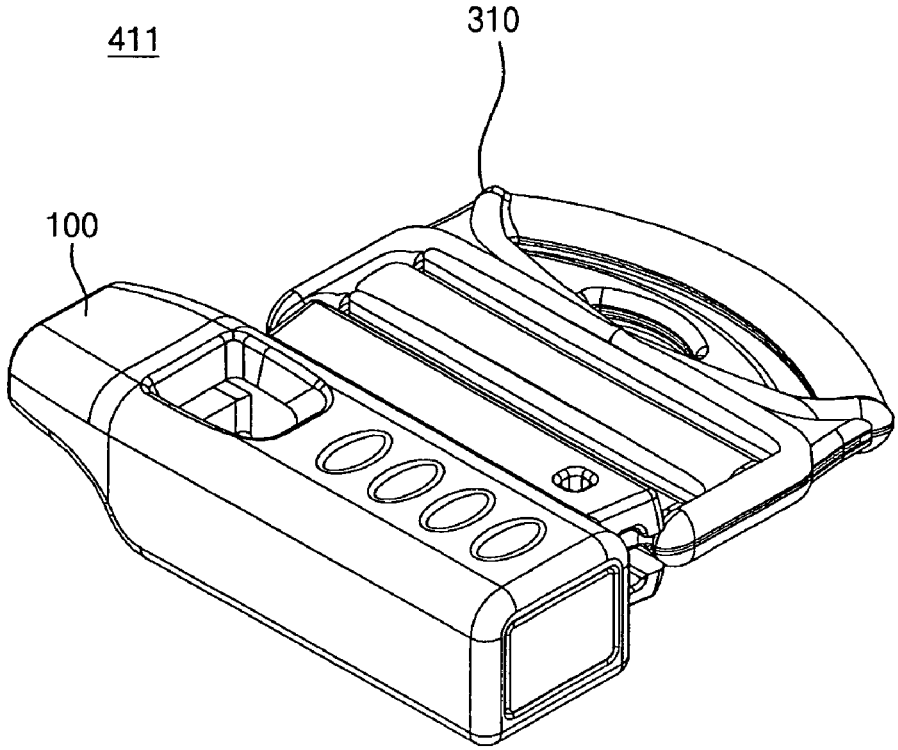
Figure 20:
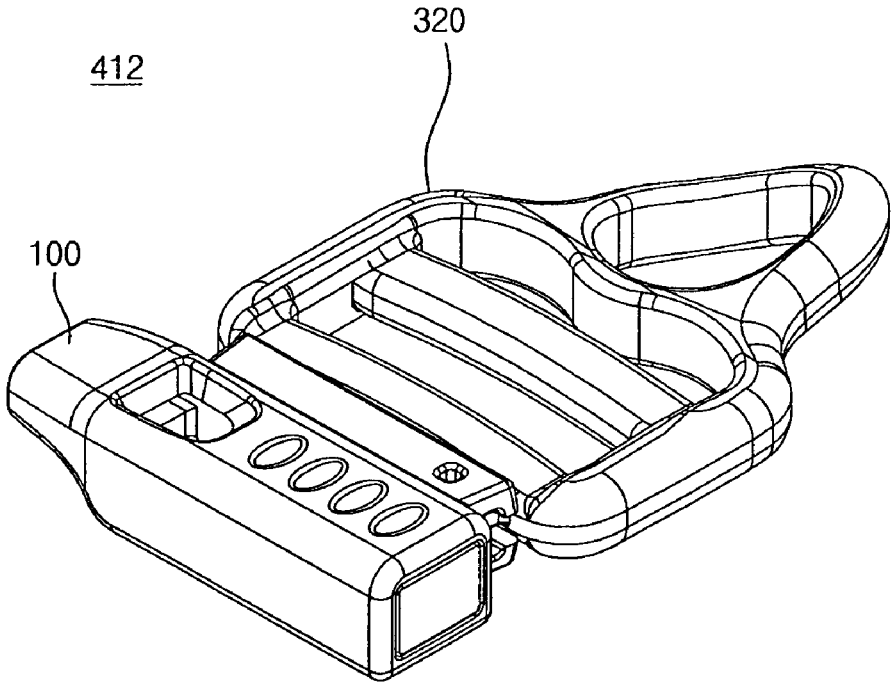

In addition, according to the closed type buckle body 250 shown in FIG. 13, hooks at the front of the male latch are inserted into the body of the female receptacle and hooked on a coupling part formed inside the female receptacle. Then, the male latch and female receptacle are separated from each other by pushing a pressing unit formed at the outside of the female receptacle.

The buckle body comprised of the male latch and female receptacle may be formed to have various functions and shapes.

In addition, as shown in FIGS. 10 to 12 and FIGS. 14 to 20, the buckle body may be formed of single body in order to adjust tension of the belt or fix the belt to goods. Also in this case, the buckle body may be formed to have various functions and shapes.

FIG. 21 shows a state that the buckle equipped with the whistle is connected to the knapsack. Generally, one buckle is used in one knapsack. However, plural buckles are provided to one knapsack in FIG. 21 for convenience of explanation.

In other words, the buckle may be mounted on a chest belt (A), a waist belt (B), a shoulder strap (C, D) or other various belts (E).

Figure 22:
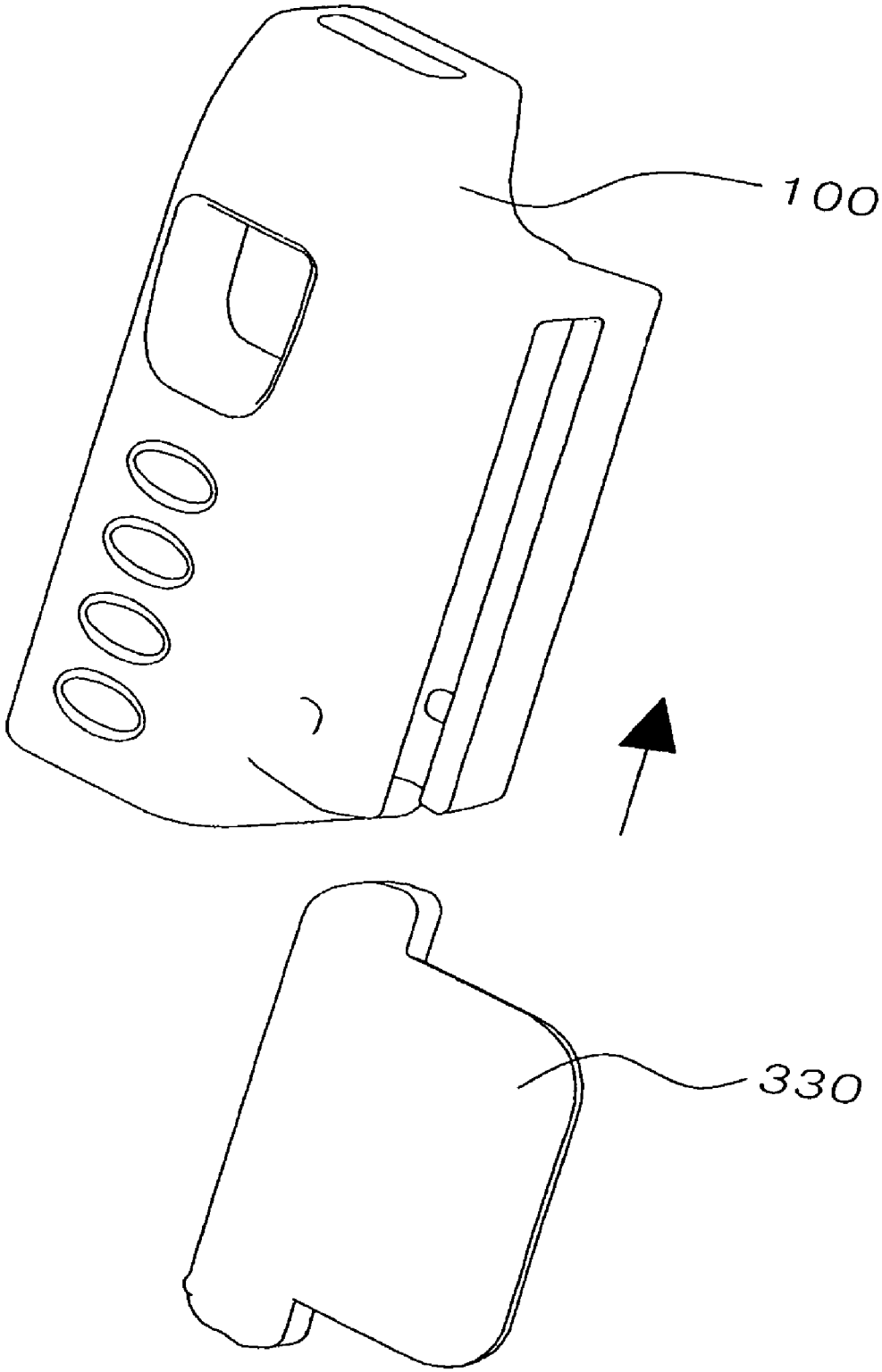
FIG. 22 is an exploded perspective view illustrating a buckle equipped with a whistle according to a still another embodiment of the present invention.
Figure 23:
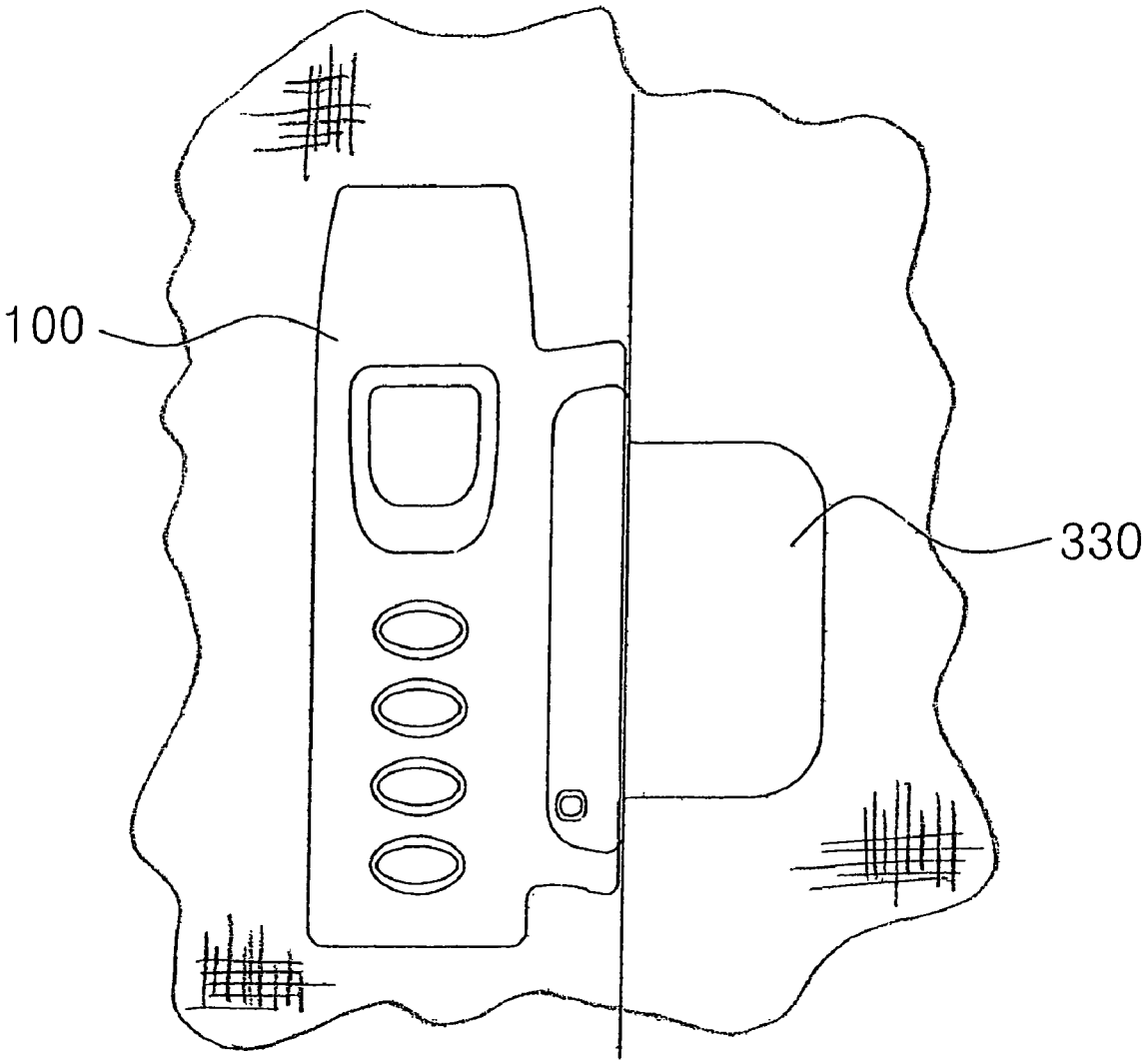
FIG. 23 is an exemplary view illustrating a state that the buckle of FIG. 22 is used.

FIGS. 22 and 23 respectively show an exploded perspective view of a buckle equipped with a whistle according to a still another embodiment of the present invention and a used state thereof.

The buckle according to the still another embodiment includes a sewing insertion part 330 formed at one side, a sliding part formed at the other side and a whistle attachable to the buckle body through the sliding part, where the sewing insertion part 330 can be sewn along a sewing line of fabrics of the knapsack, clothes or bag. The buckle body may be formed in various types.

It should be understood by those of ordinary skill in the art that various replacements, modifications and changes in the form and details may be made therein without departing from the spirit and scope of the present invention as defined by the following claims. Therefore, it is to be appreciated that the above described embodiments are for purposes of illustration only and are not to be construed as limitations of the invention.

The buckle equipped with the whistle according to the present invention produces following effects.

First, the user can easily use the whistle without unlocking the buckle because the whistle is detachable.

Second, the whistle can be separately kept when it is not necessary because the whistle is detachable. Thus, appearance of the goods can be kept good.

Third, it is possible to prevent the whistle from being polluted by keeping the whistle separately when it is not necessary because the whistle is detachable.

It should be understood by those of ordinary skill in the art that various replacements, modifications and changes in the form and details may be made therein without departing from the spirit and scope of the present invention as defined by the following claims. Therefore, it is to be appreciated that the above described embodiments are for purposes of illustration only and are not to be construed as limitations of the invention.

What is claimed is:

1. A buckle comprising:

a buckle body and a whistle, the buckle body having a plurality of first portions for either one or both of attaching or receiving respective belt portions, the buckle body having a second portion distinct from each of the first portions and to which the whistle is detachably coupled;

wherein said second portion allows slidable detachment of the whistle from said buckle body while said respective belt portions are received or attached at said first portions;

wherein all belt portions received or attached at the buckle are received or attached by said first portions independent of a coupling state between the whistle and the second portion;

wherein the second portion comprises a sliding part;

wherein the whistle comprises a whistle body to generate sound, and a connection part connected to the whistle body and configured to detachably connect to the sliding part; and wherein the connection part comprises:

a front surface provided with an insertion groove having the same shape as a first end of the sliding part, the front surface having a first edge adjacent and connected to the whistle body, wherein the first end of the sliding part is configured to be inserted into the insertion groove;

a right side surface, extending from a second edge of the front surface opposed to the first edge, the right side surface being provided with the insertion groove formed in a length direction of the connection part, where the sliding part is configured to be inserted into the insertion groove;

a flat surface extending in the length direction of the connection part from a third edge of the front surface, the third edge of the front surface extending between the whistle body and the right side surface;

a rear surface opposing the front surface in order to support the sliding part; and a bottom surface extending in the length direction of the connection part from a fourth edge of the front surface, the fourth edge of the front surface extending between the whistle body and the right side surface.

2. The buckle of claim 1, wherein the insertion groove extends toward the rear surface from a first end of the right side surface connected to the front surface.

3. The buckle of claim 2, wherein the insertion groove extends to a position of the right side surface that is a predetermined distance from the rear surface.

4. The buckle of claim 1, wherein the insertion groove extends to the rear surface from a first end of the right side surface connected to the front surface.

5. The buckle of claim 1, wherein the insertion groove extends through the front surface, the right side surface and the rear surface.

6. The buckle of claim 1, wherein a projection is formed on the sliding part, and at least one of the flat surface and the bottom surface is provided with a fixing groove into which the projection formed on the sliding part is inserted and fixed.

7. The buckle of claim 6, wherein the fixing groove is formed at a position closer to the front surface than the rear surface.

8. The buckle of claim 6, wherein the fixing groove is formed at a position closer to the rear surface than the front surface.

9. A buckle comprising:

a buckle body and a whistle, the buckle body having a plurality of first portions for either one or both of attaching or receiving respective belt portions, the buckle body having a second portion distinct from each of the first portions and to which the whistle is detachably coupled;

wherein said second portion allows slidable detachment of the whistle from said buckle body while said respective belt portions are received or attached at said first portions;

wherein all belt portions received or attached at the buckle are received or attached by said first portions independent of a coupling state between the whistle and the second portion: and wherein the buckle body further comprises:

a male latch comprising one of the first portions and configured to be connected to the first belt end; and a female receptacle comprising another of the first portions, being configured to be connected to the second belt end and being configured to receive and fix the male latch.

10. The buckle of claim 9, wherein the sliding part is formed on the male latch or the female receptacle.

11. The buckle of claim 9, wherein the male latch is configured to be separated from the female receptacle by pressing on an outwardly biased portion of the male latch to move the outwardly biased portion into the same position as when the male latch is received in the female receptacle.

12. The buckle of claim 9, wherein the female receptacle comprises a pressing unit on an outer surface of the female receptacle, and the male latch of the buckle body is configured to be separated from the female receptacle by actuating the pressing unit formed on the outside of the female receptacle.

13. A buckle comprising;

a buckle body and a whistle, the buckle body having, a plurality of first portions for either one or both of attaching or receiving respective belt portions, the buckle body having a second portion distinct from each of the first portions and to which the whistle is detachably coupled;

wherein said second portion allows slidable detachment of the whistle from said buckle body while said respective belt portions are received or attached at said first portions;

wherein all belt portions received or attached at the buckle are received or attached by said first portions independent of a coupling state between the whistle and the second portion; and wherein a sliding motion for said slidable detachment occurs in a direction orthogonal to a separation direction.

14. A buckle comprising:

a buckle body and a whistle, body having a plurality of first portions for either one or both of attaching or receiving respective belt portions, the buckle body having a second portion distinct from each of the first portions and to which the whistle is detachably coupled:

wherein said second portion allows slidable detachment of the whistle from said buckle body while said respective belt portions are received or attached at said first portions;

wherein all belt portions received or attached at the buckle are received or attached by said first portions independent of a coupling state between the whistle and the second portion; and wherein the buckle body comprises a male latch member forming one first portion of the plurality of first portions, and a female receptacle member comprising another first portion of the plurality of first portions, the male latch member inserted into and coupled to the female receptacle member to achieve a locked state, and wherein one member of either the male latch member and female receptacle member further comprises the second portion, wherein said second portion is a distinct coupling independent of the male latch member to female receptacle member coupling, said distinct coupling allowing slidable detachment of the whistle from said one member while the buckle is in the locked state.

15. The buckle of claim 14, wherein each one member of said male latch member and female receptacle member comprise a portion for coupling to a belt.

* * * * *